US006709229B1

(12) United States Patent
Lee

(10) Patent No.: US 6,709,229 B1
(45) Date of Patent: Mar. 23, 2004

(54) BI-DIRECTIONAL INCOMING AIR FLOW FAN

(76) Inventor: Bill Lee, No. 148, Tei-Ho Rd., Chu-Pei City, Hsin-Chu Hsien (TW)

( * ) Notice: Subject to any disclaimer, the term of this patent is extended or adjusted under 35 U.S.C. 154(b) by 0 days.

(21) Appl. No.: 10/139,504

(22) Filed: May 7, 2002

(51) Int. Cl.[7] ..... F01D 3/02

(52) U.S. Cl. ..... 415/102; 415/98; 415/184; 415/206; 416/231.8; 361/697

(58) Field of Search ..... 415/102, 206, 415/119, 98, 184, 175, 178; 416/231 B, 185, 184, 182, 183, 228 B, 203; 361/697

(56) References Cited

U.S. PATENT DOCUMENTS 2,936,947 A * 5/1960 Staak
4,470,753 A * 9/1984 Witzel ..... 415/116
4,639,193 A * 1/1987 Reichert et al. ..... 416/184
6,030,173 A * 2/2000 Bacchiocchi ..... 415/98
6,210,118 B1 * 4/2001 Egawa et al. ..... 416/243
6,540,476 B2 * 4/2003 Huang et al. ..... 415/98

* cited by examiner

*Primary Examiner*—Edward K. Look
*Assistant Examiner*—J. M. McAleenan
(74) *Attorney, Agent, or Firm*—Birch, Stewart, Kolasch & Birch, LLP

(57) ABSTRACT

A bi-directional incoming air flow fan comprises a case in which is mounted a rotor that includes a plurality of rotary blades. The case has top and bottom faces that are respectively provided with a first and second air inlet having approximately a same surface area. A side of the case is further provided with an air outlet. Furthermore, each rotary blade includes upper and lower sides that respectively have an axial flow guiding rib, and a free section that is inclined to form a radial flow section. Thereby, once the rotor (40) is put in rotation, air flow amount and pressure are increased by means of the axial flow guiding ribs (61) that create an uniform air flow. As a result, rotor deviation and floating force are reduced, thereby reducing mechanical frictions and parasitic noise.

6 Claims, 4 Drawing Sheets

BI-DIRECTIONAL INCOMING AIR FLOW FAN

FIELD OF THE INVENTION

The invention relates to a bi-directional incoming air flow fan and, more particularly, a bi-directional incoming air flow fan used in a computer assembly to dissipate heat.

BACKGROUND OF THE INVENTION

Electrical fans are usually used to create an air flow and commonly provide the possibility of changing the outputted air flow direction. Electrical fans can be differentiated from their directions of air flow input and output. Such a differentiation principally leads to a distinction between axial flow type fans and centrifuge type fans. Axial flow type fans have the characteristics of generating an incoming air flow from the rotation axis of the rotary blades, the air flow then is compressed and outputted along the same rotation direction. In contrast, centrifuge type fans generate an axial incoming air flow that is outputted along the radial direction of the rotary blades.

Centrifuge type fans are traditionally known as blowers, and are usually comprised of a case and a rotor mounted in the case. It is further common that the case includes an axial face that has an air inlet and a radial face that has an air outlet. The rotor includes a plurality of rotary blades that, once put in rotation, generate an incoming air flow from the air inlet axially disposed, and an outgoing air flow through the air outlet.

Because a single face of the above traditional fan is provided with an air inlet, higher air flow amount therefore cannot provided. The prior art thus also provides a centrifuge type fan having a bi-directional incoming air flow. In this type of known fan, two axial faces of the case are respectively provided with an air inlet. However, because the air inlets do not have an equal surface area, incoming air flows are therefore not symmetrical when the rotor rotates, which causes deviation and generation of a floating force or compressive force to which the rotor is negatively subjected to. This results in an increase of friction and vibration of the rotor, which affects the life service of the fan and further generates parasitic noise.

SUMMARY OF THE INVENTION

It is therefore a principal object of the invention to provide a centrifuge type fan with bi-directional incoming air flow that can achieve a uniform incoming air flow from two sides, thereby reducing a deviation of the rotor and mechanical frictions due to a floating force, while providing a higher amount of air flow output.

To accomplish the above and other objectives, a bi-directional incoming air flow fan of the invention comprises a case in which is mounted a rotor that includes a plurality of rotary blades. The case has top and bottom faces that are respectively provided with a first and second air inlet having approximately a same surface area. A side of the case is further provided with an air outlet. Furthermore, each rotary blade includes an upper and lower sides that respectively have an axial flow guiding rib, and a free section that is inclined to form a radial flow section. Thereby, once the rotor is put in rotation, air flow amount and pressure are increased by means of the axial flow guiding ribs that create an uniform air flow. As a result, rotor deviation and floating force are reduced, thereby reducing mechanical frictions and parasitic noise.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
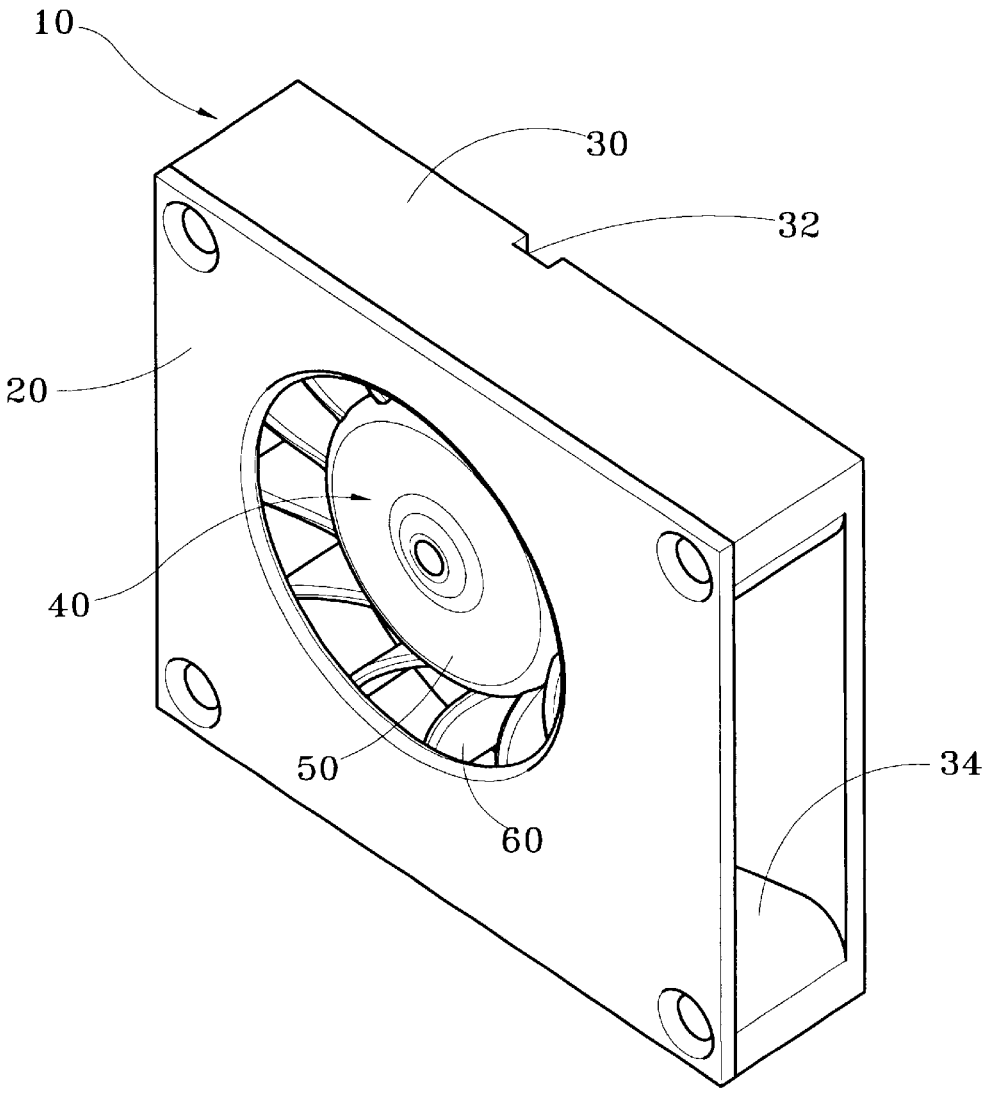
FIG. 1 is an external perspective view illustrating a bi-directional incoming air flow fan according to an embodiment of the invention.

Wherever possible in the following description, like reference numerals will refer to like elements and parts unless otherwise illustrated.

Referring to FIG. 1, an external perspective view schematically illustrates a fan with bi-directional incoming air flow according to an embodiment of the invention. As shown in FIG. 1, the fan comprises a case 10 in which is assembled a rotor 40.

Figure 2:
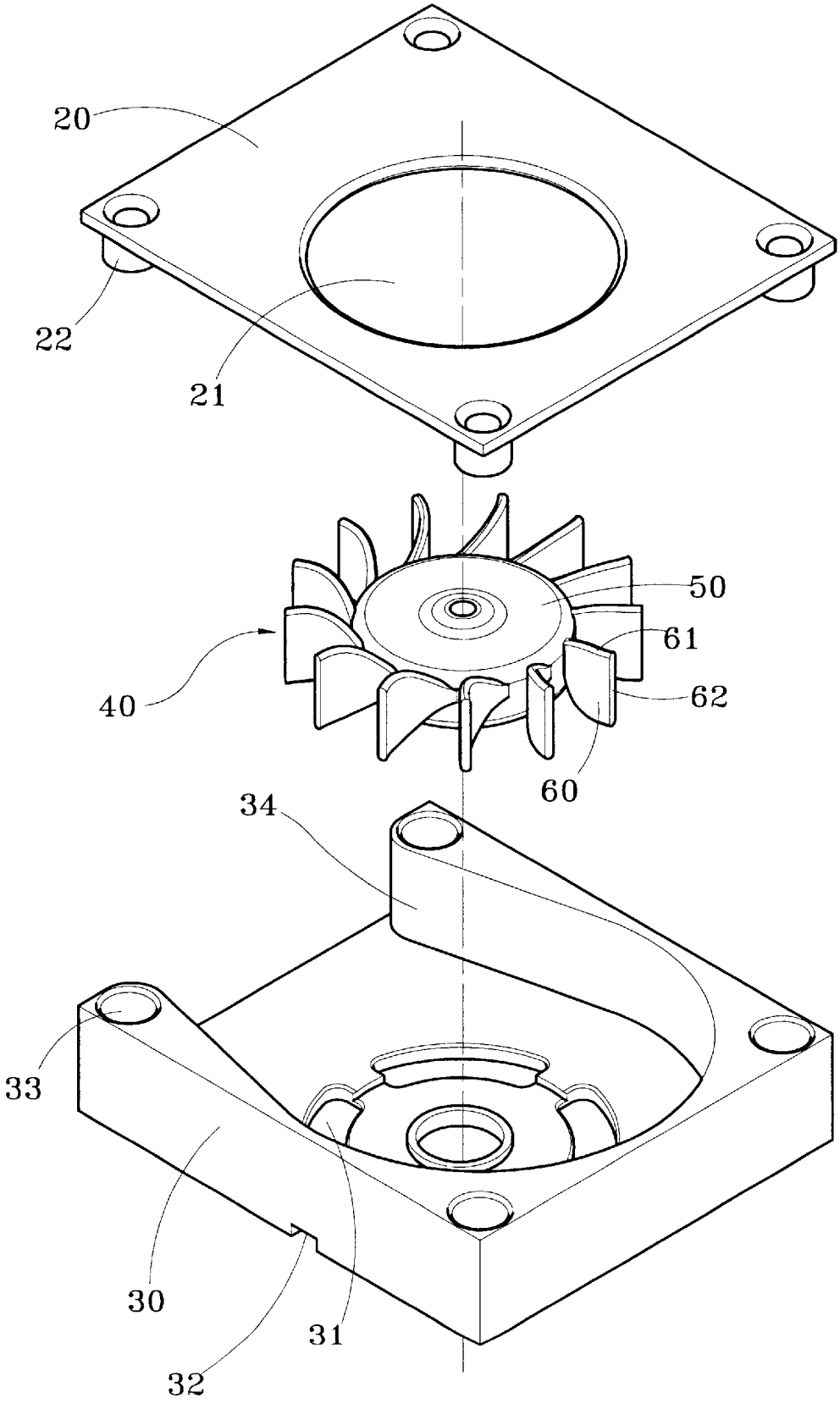
FIG. 2 is an exploded view illustrating the fan according to an embodiment of the invention.
Figure 3:
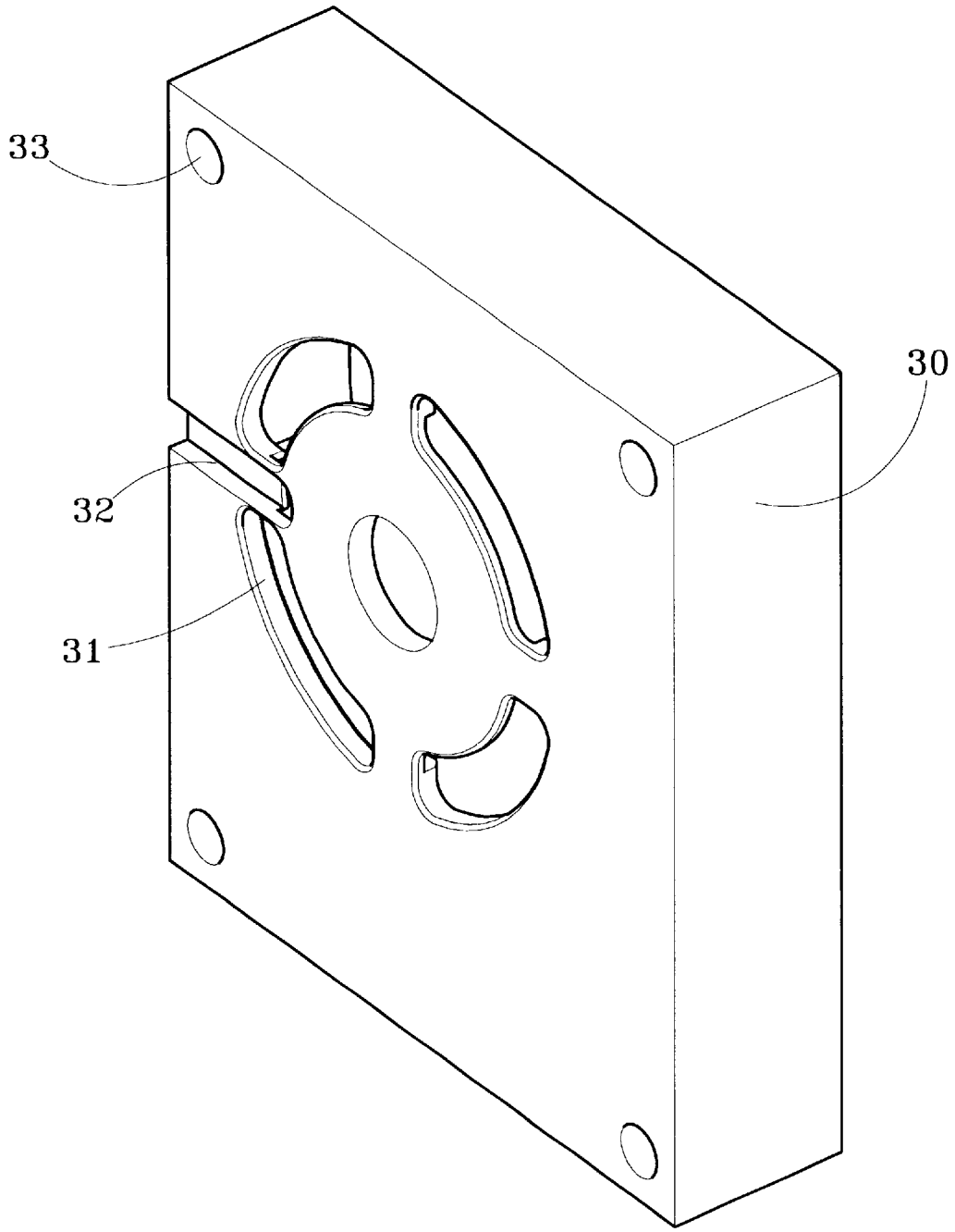
FIG. 3 is a perspective view of the lower cover of the invention.
Figure 4:
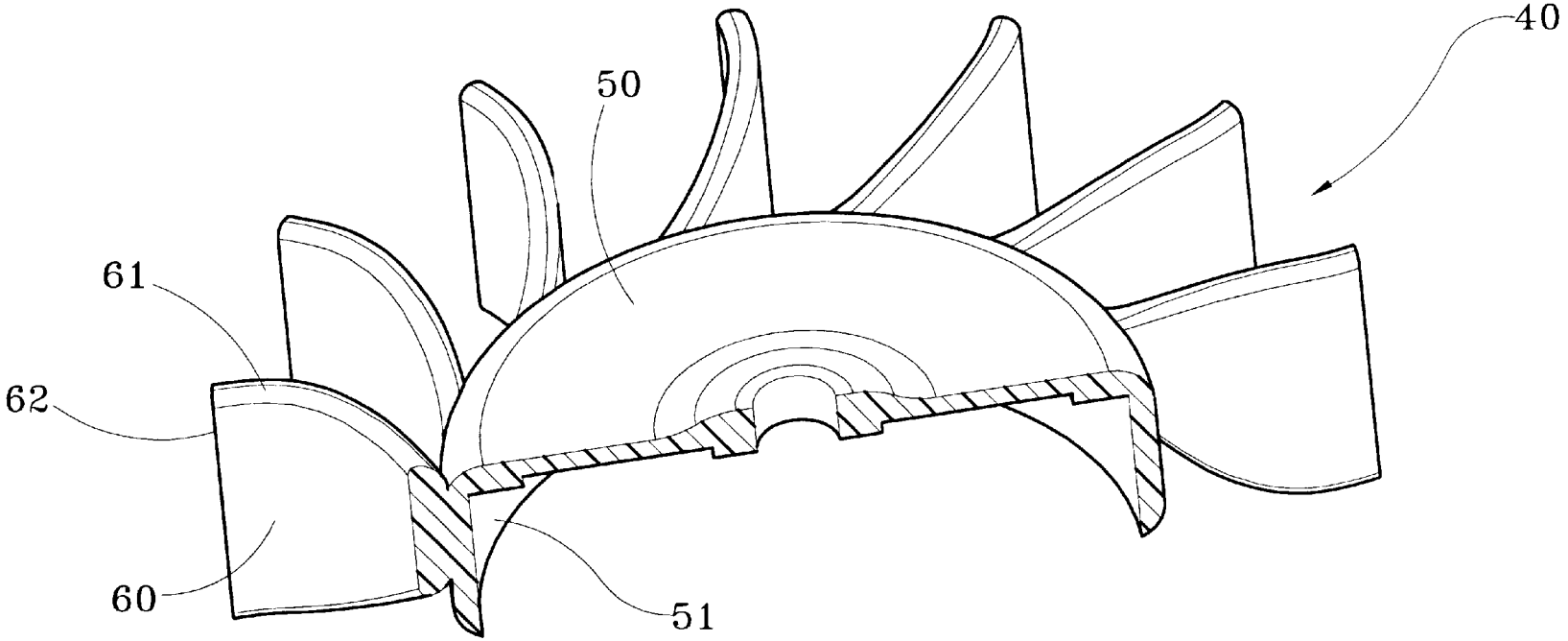
FIG. 4 is a partial section view of the rotor of the invention.

FIG. 2 is an exploded view of the fan according to an embodiment of the invention. As illustrated, the case 10 is comprised of lower and upper covers 20, 30 assembled with each other. On axial faces corresponding to the rotation axis of the rotor 40, the lower and upper covers 20, 30 are respectively provided with first and second air inlets 21, 31 of about a same surface area. On a side of the lower cover 20 is further arranged an air outlet 34. Meanwhile, a slot 32 (better seen in FIG. 3) is arranged on another side of the lower case 20 corresponding to the periphery of the second air inlet 31. With further reference to FIG. 4, the rotor 40 is comprised of a central pivot head 50 at a periphery of which are disposed a plurality of rotary blades 60. The pivot head 50 is further provided with a recess 51 that is arranged in a manner to receive a driving unit (not shown), the connection wires of the driving unit can be received in the slot 32.

Each rotary blade 60 is oriented forward of an inclination angle of 30°–120° and radially extends outward, with a surface area progressively increasing from the interior (head 50 side) to the exterior. Axial flow guiding ribs 61 are respectively arranged on upper and lower sides of each blade 60 to axially guide incoming air flow. A free section of each blade 60 is further forward inclined 15°–60° to form a radial flow section 62 through which air flow is radially guided outward. By means of the axial flow guiding ribs 61 that uniformly guide air flows, the air flow amount and air flow pressure are increased while the deviation and floating force to which the rotor 40 is usually subjected are reduced, mechanical frictions and parasitic noise are therefore favorably reduced.

The lower and upper covers 20, 30 are provided with connecting portions/slots 22, 33 that assemble with one another once the rotor 40 is mounted.

In use, the rotor rotates under the drive of the driving unit (not shown). The rotation of the rotary blades 60 drives air flow to axially penetrate the case 10 by means of the axial flow guiding ribs 61. Due to an identical section of the first and second air inlets 21, 31 and a similar direction of the axial flow guiding ribs 61 of the rotary blades 60, incoming air flow can be therefore uniformly guided from the two sides of the case 10. Via this balanced incoming air flow, the deviation, floating force, and compressive force to which the rotor 40 is usually subjected to due to air flow circulation are favorably reduced, meanwhile the air flow amount and air flow pressure are increased. Furthermore, the friction between the bearings and other different elements of the fan (not shown) is also reduced, which results in noise reduction and extends the service life of the elements of the fan. Air flow entering the case 10 is oriented toward the air outlet 34 by means of the radial flow sections 62 of the rotary blades 60. Thereby, a revolution cycle can achieve an air flow that incomes from two sides and radially outgoes.

Because the fan of the invention can achieve a bi-directional incoming air flow, the amount of air flow outputted by the fan of the invention is relatively greater than traditional fans having a same volume. Within electric appliances having small placement space while requiring a relatively high thermal dissipation such as computer assemblies, the fan of the invention is therefore particularly advantageous because it allows either a better thermal dissipation for a same fan volume, or a reduced size for equal performance of thermal dissipation, thereby allowing releasing more space. Moreover, by achieving a bi-directional incoming air flow, the invention can reduce the rocking of the rotor 40 in rotation, thereby reducing negative friction and parasitic noise and extending the life span of the fan.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A bi-directional incoming air flow fan, comprising:

a case, having a top face and a bottom face respectively provided with first and second air inlets of about the same surface area, a side of the case being further provided with an air outlet; and a rotor, mounted within the case, including a plurality of rotary blades, each rotary blade including upper and lower sides respectively provided with an axial flow guiding rib, and a free section that is inclined in a manner to form a radial flow section;

thereby the axial flow guiding ribs uniformly guide air flow to increase air flow amount and air flow pressure while reducing a deviation and a floating force to which the rotor is subjected, thereby reducing mechanical friction and parasitic noise.

2. The fan of claim 1, wherein the first and second air inlets are respectively formed on lower and upper covers that assemble to each other to form the case.

3. The fan of claim 2, wherein the upper and lower covers are respectively provided with connecting portions and connecting slots that assemble with one another.

4. A The fan of claim 2, wherein a side of the lower cover is further provided with a slot into which electrical wires of the driving unit are received.

5. The fan of claim 1, wherein the rotor includes a central pivot head that is provided with a recess to mount a driving unit therein.

6. The fan of claim 1, wherein each rotary blade is inclined forward of 30°–120° and extends outward, while having a surface area that progressively increases from the inward to the outward to form one axial flow guiding rib, the free section of each rotary blade being further inclined forward 15°–60° to form one radial flow section that guides outgoing air flow.

* * * * *